US007393506B2

(12) United States Patent
Sollböhmer

(10) Patent No.: US 7,393,506 B2
(45) Date of Patent: Jul. 1, 2008

(54) SAMPLE CARRIER

(75) Inventor: Olaf Sollböhmer, Hamburg (DE)

(73) Assignee: Evotec Oai AG, Hamburg (DE)

( * ) Notice: Subject to any disclaimer, the term of this patent is extended or adjusted under 35 U.S.C. 154(b) by 175 days.

(21) Appl. No.: 10/466,883

(22) PCT Filed: Jan. 9, 2002

(86) PCT No.: PCT/EP02/00117

§ 371 (c)(1),
(2), (4) Date: Sep. 7, 2004

(87) PCT Pub. No.: WO02/055197

PCT Pub. Date: Jul. 18, 2002

(65) Prior Publication Data

US 2005/0063878 A1 Mar. 24, 2005

(51) Int. Cl.
*B01L 3/00* (2006.01)

(52) U.S. Cl. ..... 422/102; 422/104

(58) Field of Classification Search ..... 422/102, 422/104

See application file for complete search history.

(56) References Cited

U.S. PATENT DOCUMENTS

| | | | | |
|---|---|---|---|---|
| 4,948,442 | A | 8/1990 | Manns | |
| 5,487,872 | A * | 1/1996 | Hafeman et al. | 422/102 |
| 6,018,388 | A * | 1/2000 | Nawracala et al. | 356/246 |
| 6,406,636 | B1 * | 6/2002 | Vaganov | 216/2 |
| 2003/0033892 | A1 * | 2/2003 | Zwick et al. | 422/102 |

FOREIGN PATENT DOCUMENTS

| | | | |
|---|---|---|---|
| DE | 92 18 704.8 | | 3/1995 |
| DE | 44 12 893 | A1 | 10/1995 |
| DE | 195 24 795 | A1 | 1/1997 |
| DE | 198 06 681 | A1 | 8/1999 |
| DE | 198 18 481 | A1 | 10/1999 |
| DE | 198 47 991 | A1 | 4/2000 |
| EP | 0 571 661 | A1 | 12/1993 |
| EP | 0 695 941 | A2 | 2/1996 |
| EP | 0 707 153 | A1 | 4/1996 |
| WO | WO 01 94018 | A1 | 12/2001 |

OTHER PUBLICATIONS

International Preliminary Examination Report dated Aug. 8, 2002.
German PTO Report dated Apr. 10, 2001.
International Search Report, completed Jun. 10, 2002.

* cited by examiner

*Primary Examiner*—Jill Warden
*Assistant Examiner*—Natalia Levkovich
(74) *Attorney, Agent, or Firm*—Griffin & Szipl, P.C.

(57) ABSTRACT

A sample carrier for receiving chemical and/or biological samples includes a receiving part (30) provided with deepened portions (32) for receiving the samples, and a base part (38) closing the deepened portions (32), the base part (38) being connected to the receiving part (30) at connection sites (37) by means of a bonding agent, characterized in that the receiving part (30) and/or the base part (38) are provided, at the connection sites (37), with at least one recess (44,52,60) for receiving excess bonding agent. Thus, the sample carrier includes a receiving part having recesses for receiving samples. The recesses are sealed by means of the base part. The base part is glued to the receiving part. The receiving part has a slit-shaped recess for receiving excess glue in order to prevent glue from spreading to the outside of the base part.

22 Claims, 2 Drawing Sheets

SAMPLE CARRIER

This is a National Phase Application in the United States of International Patent Application No. PCT/EP02/00117 filed Jan. 9, 2002, which claims priority on German Patent Application No. 20100345.7, filed Jan. 9, 2001.

FIELD OF THE INVENTION

The invention relates to a sample carrier for receiving chemical and/or biological samples.

BACKGROUND OF THE INVENTION

Sample carriers of the above type comprise a receiving part with deepened portions formed therein. The samples provided for examination will be introduced into the deepened portions. Part of the deepened portions are formed to extend wholly through the receiving part; therefore, these deepened portions are closed by a base part. The base part is provided e.g. as a glass plate or a transparent film. Normally, the base part is permeable to light of specific wavelengths so that the samples accommodated in the continuous deepened portions can be examined using a microscope or the like. Especially for the application of screening methods, the base part is permeable to visible light. In examination methods such as the screening method, use is made also of sample carriers wherein the base parts are not transparent to visible light. Such sample carriers will then comprise base parts is which are permeable to specific wavelength ranges in which e.g. a fluorescence of sample components will occur.

The sample carriers can be e.g. titration plates having their individual deepened portions arranged at uniform distances from each other. Particularly, the samples received in the deepened portions are minimum-sized samples of a volume smaller than 1 ml. Further, titration plates are already known which are suited for the examination of sample quantities in the microliter or even sub-microliter range.

Further, the sample carriers can be provided as chips. In chip-like sample carriers, the deepened portions are normally formed as one or a plurality of channels, and the chips contain one or a plurality of liquid reservoirs. For instance, the chips can be microfluidic chips comprising preferably two reservoirs connected to each other via a channel. Between the two reservoirs, a fluid exchange will occur which can be controlled by suitable valves, membranes and/or ion barriers. Such chips are useful, for instance, for controlling the mixing behavior of liquids, e.g. under the influence of electromagnetic forces. To allow for the examination of the behavior of the liquids, the bottom of a liquid reservoir and/or of a chip channel is preferably transparent. For this purpose, in turn, a base part is provided in order to close the deepened portions such as e.g. the reservoirs or the channel. The base part preferably is a glass plate or a transparent film.

Attachment of the base parts to the receiving part comprising the deepened portions is performed e.g. by bonding. For this purpose, the receiving part 10 (FIG. 3) is provided with a rectangular deepened portion 12 into which a glass plate 14 is inserted. The glass plate 14 will thus be centered in the rectangular deepened portion 12. The bonding agent is applied e.g. by tampon pressure onto the inner side 16 of base part 14 and onto the bottom side 18 of receiving part 10 comprising the deepened portions 20. Since the base part 14 must close the deepened portions 20 tightly, the base part 14 is firmly pressed onto the bottom side 18 of receiving part 10. Further, it has to be safeguarded that bonding agent is applied between all of the webs of the deepened portions 20 serving as connection points. In such known sample carriers, bonding agent 22 will be squeezed out along the outer edge of base part 14. This excess bonding agent 22 reaches a lower edge 24 of base part 14.

In the above process, it may happen that bonding agent 22 flows so far into the interior region that outer deepened portions 20 will be at least partially covered by the bonding agent 22. This has the consequence that an optical examination of the samples located in these deepened portions 20 is adulterated because the light signal is e.g. refracted by the bonding agent. Thus, after the base part 14 has been attached by bonding, it is required to clean the base part in the edge region. Cleaning is performed e.g. by a piece of cloth soaked with alcohol or the like. In this case, residues remain on the outer side 24 of base part 14. These will cause adulterations of the measurement results. As a result, the outer deepened portions are often unfit for use.

It is an object of the invention to provide a sample carrier for receiving chemical and/or biological samples wherein a contamination of the base part which would impair the examination of the samples is avoided.

SUMMARY OF THE INVENTION

According to the invention, the above object is achieved by a sample carrier For receiving chemical and/or biological samples, which includes a receiving part (30) provided with deepened portions (32) for receiving the samples, and a base part (38) closing the deepened portions (32), the base part (38) being connected to the receiving part (30) at connection sites (37) by means of a bonding agent, characterized in that the receiving part (30) and/or the base part (38) are provided, at the connection sites (37), with at least one recess (44,52,60) For receiving excess bonding agent. In accordance with another embodiment, inner edges (39) of the receiving part (30) facing towards the deepened portions (32) are provided with a flank or rounded portion (54). In accordance with another embodiment, the recess (44) is provided in an edge region (41) of the base part (38) and/or of the receiving part (30). In another embodiment of the invention, the recess (44) is open in the direction of an outer edge (43) of the receiving part (30).

The sample carrier comprises a receiving part provided with deepened portions for receiving the samples. Connected to the receiving part is a base part closing the deepened portions. The connection is performed by bonding attachment of the receiving part to the base part along connection sites. For the connection sites, use is made e.g. of the webs arranged between the deepened portions. According to the invention, the receiving part and/or the base part are provided with at least one recess for receiving excess bonding agent. The recess can be provided e.g. in the manner of bulged or deepened regions in the receiving part's bottom side facing towards the base part. Since, according to the invention, it is to be precluded that bonding agent is squeezed out laterally on the edge of the base part and reaches the outer side, the recesses are preferably arranged in the edge region of the base part and/or in the edge region of the receiving part. The size and/or the number of the recesses is preferably selected to the effect that the maximum amount of excess bonding agent can be accommodated.

The provision of the recesses of the invention offers the advantage that no bonding agent will reach the outer side of the base part facing towards the outside. Thus, it is precluded that measurement results are adulterated or affected due to layers of bonding agent or residues of bonding agent. Further, there is obviated the need for the working step of wiping off the outer side for removing excess bonding agent. Thereby, the production costs are reduced and the quality of the sample carriers, particularly with respect to the their optical characteristics, is noticeably improved.

Preferably, the sample carrier comprises a plurality of recesses arranged in such a manner that, in the critical edge region, a sufficient quantity of excess bonding agent can be received. Further, a recess can be provided in the form of a channel closed in itself and surrounding all of the deepened portions along the edge region of the receiving part. By way of alternative or additionally, recesses can be provided between the deepened portions. This offers the advantage that excess bonding agent will be received also in this region and no disturbing quantities of bonding agent will enter the deepened portions. Further, the inventive provision of such recesses has the advantage that the dosage of the bonding agent quantity is allowed to be less precise. Preferably, the recess is formed by a stepped portion provided in the receiving part outside of the deepened portions. Thus, when assembling the receiving part with the base part, the bonding agent can in the edge region escape away from the edge region. Preferably, the stepped portion extends in the manner of a frame around all of the deepened portion so that plastic which is pressed in all four direction towards the outside can escape through the recess formed in the stepped portion. If desired, the stepped portion can be interrupted by centering webs used for the centering of the base part during the bonding-attachment process.

In a preferred embodiment, the base part is configured to project beyond the stepped portion, thus forming a gap-shaped recess. This offers the advantage that bonding agent which is pressed into the recess formed by the stepped portion, cannot be pressed into the direction of the outer face of the base part or flow in this direction. Instead, the bonding agent is retained in the gap-shaped recess by means of the projecting base part and will harden in the recess. This has the additional advantage that the excess bonding agent is used for effecting an additional fixation of the base part to the receiving part. Preferably, the gap-shaped recess is formed to extend substantially continuously along the edge of the base part so that, during the bonding attachment of the receiving part, all of the bonding agent which is pressed out into all four directions on the base part can be taken up.

For safeguarding that also in case of large quantities of excess bonding agent, the latter will not advance to the outer side of the base part, the recess is preferably open in the direction of an outer edge.

The base part is preferably provided as a base part which is permeable to radiation to allow for the examination of the sample. Particularly, the base part is transparent to wavelength ranges used in FCS-spectroscopy and/or to visible light. Particularly useful for such purposes is a base part made of glass or a suited plastic film. The thickness of the base part is preferably smaller than 500 μm, preferably smaller than 300 μm.

The invention will be explained in greater detail hereunder with reference to the drawings.

DETAILED DESCRIPTION OF THE INVENTION

Figure 1:
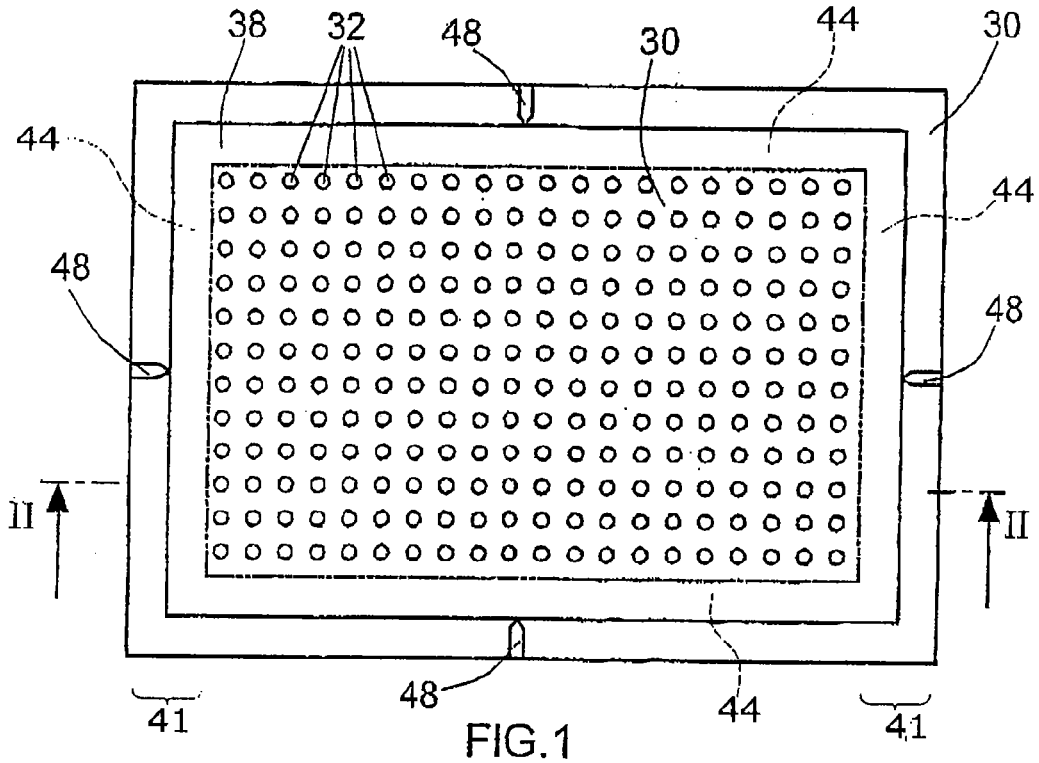
FIG. 1 is a schematic bottom view of a sample carrier formed as a titration plate.

For reasons of clarification, the titration plates are illustrated with the base part facing upwards. Normally, the titration plates are produced in this orientation.

A sample carrier comprises a receiving part 30. The receiving part 30 is provided with deepened portions 32 arranged in columns and rows, presenting a matrix-like configuration. The deepened portions 32 are substantially cylindrical and extend from an upper side 34 of the receiving part 30 to a bottom side 36 through the receiving part 30. The deepened portions 32 are closed by a base part 38. For this purpose, the base part 38 is attached by bonding onto the bottom side 36 of receiving part 30. The base part 38 is e.g. a glass plate having a thickness of less than 500 μm.

The receiving part comprises a stepped portion 42 formed in the edge region 40 of base part 38. The stepped portion 42 extends in a frame-like manner along the whole outer edge of receiving part 30.

The base part 38 is arranged to extend beyond the outer side on all four directions. Thus, 30 the edge region 40 of base part 38 substantially does not rest on the outer side 36 of receiving part 30. Because of the projecting portion of base part 38, a gap-shaped recess 44 is formed. Along all of its outer edge, the gap 44 extends in the manner of a frame around the recesses 32.

Thus, during the bonding attachment of the receiving part 30 to the base part 38, the excess bonding agent 46 applied onto the base part or the outer side 36 of receiving part 30 escape into the gap-shaped recess 44.

Further, the illustrated sample carrier is provided with centering elements 48. The centering elements 48 serve for the centering of the base part 38 during the bonding attachment of the base part 38 and the receiving part 30. By the centering elements 48, it is avoided that the base part 38 slides out of position during the bonding process. The centering elements can be formed as webs which on the side facing towards the base part 38 are formed with a taper, thus providing substantially only a line-shaped contact between the centering elements 48 and the base part 38. Alternatively, the centering elements can be provided e.g. as cylindrical centering pins for placement of the base part 38 therebetween. Further, the centering elements 48 can be configured to allow them to be removed after the base part 38 has been bonded to the receiving part 30. For this purpose, the centering elements 48 can be provided with a predetermined weakening line so that they will break off when bent repeatedly back and forth. This offers the advantage that, once the centering elements 48 have been removed, the carrier plate will have a plane underside and that no centering elements or other parts of the carrier plate will project from the underside of the carrier plate. Further, it is possible to select the height of the centering elements 48 in such a manner that, with the base part 38 inserted, they will not project from the underside of the carrier plate. Preferably, the centering elements 48 end at about half the height of base part 38.

Figure 2:
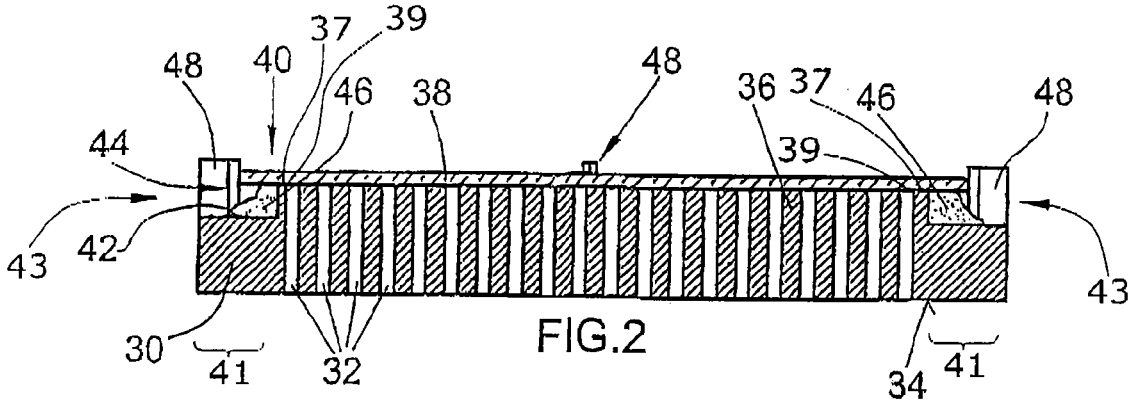
FIG. 2 is a schematic sectional view taken along the line II-II in FIG. 1.
Figure 3:
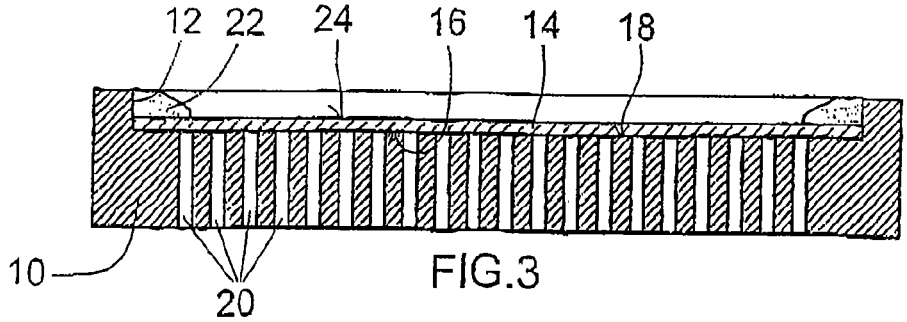
FIG. 3 is a sectional view of a titration plate according to the state of the art.
Figure 4:
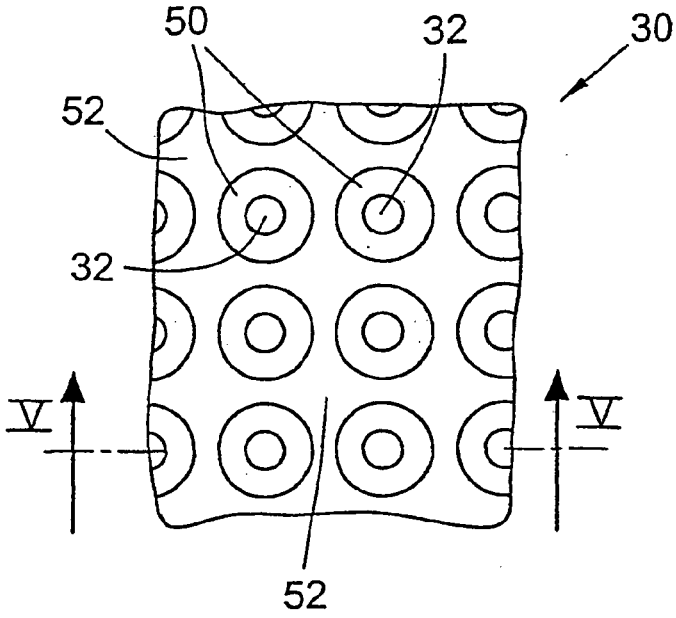
FIG. 4 is a schematic plan view of a further embodiment of a receiving portion configured according to the invention.
Figure 5:
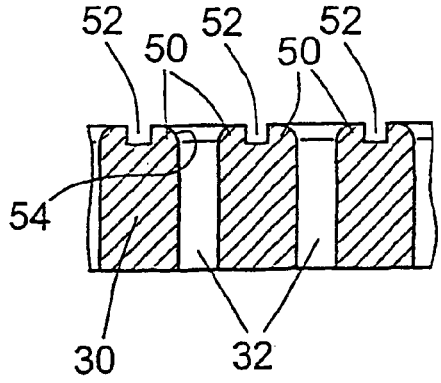
FIG. 5 is a sectional view taken along the line V-V in FIG. 4.

In the embodiment shown in FIGS. 4 and 5, only the receiving part 30 is illustrated. The receiving part 30 is closed by a base part such as a glass plate, with the base part in FIG. 5 being arranged above the shown receiving part 30 by being bonded onto the latter. The receiving part 30 is provided with deepened portions 32 corresponding to the above described titration plates. In the illustrated embodiment, the titration plates are surrounded by annular protrusions 50. The individual annular protrusions 50 do not contact each other in the embodiment shown. In this manner, a recess 52 is formed between the annular protrusions 50. The recess 52 is provided to receive bonding agent, as has been the case for recess 44 (FIG. 2).

As illustrated in FIG. 5, the annular projections 50 are formed to have such a cross-sectional configuration that the inner side facing towards the deepened portions 32 comprises a flank or rounded portion 54. Thus, due to the bonded base part 38 (FIG. 2), the annular projections 50 and the base part 38 have a wedge-shaped slot formed between them into which the bonding agent is sucked by the occurring capillary forces. This further contributes to the prevention of a contamination by bonding agent in the base part in the region of the deepened portions 32.

Figure 6:
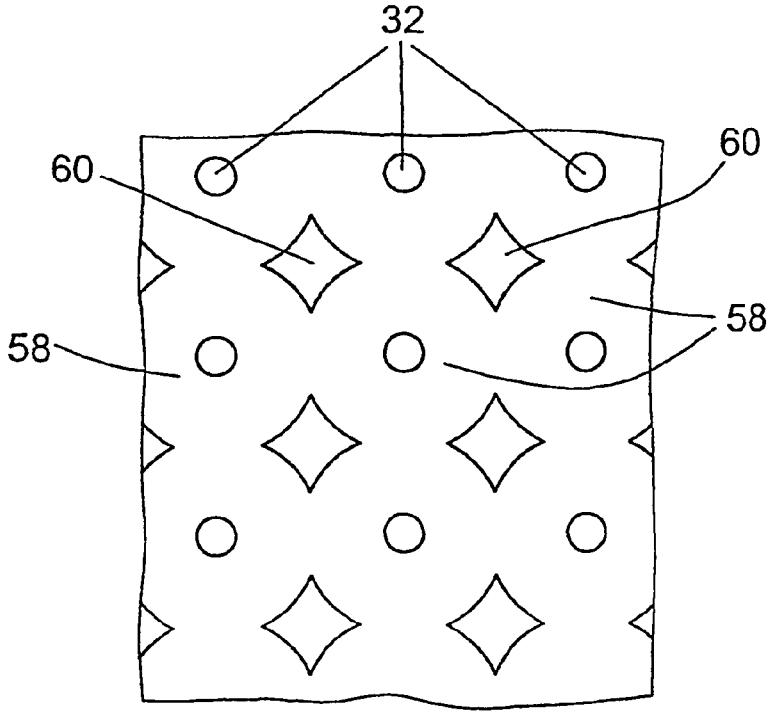
FIG. 6 is a schematic plan view of a further embodiment of a receiving part according to the invention.

The embodiment shown in FIG. 6 is an embodiment similar to the one shown in FIGS. 4 and 5, wherein, instead of the annular projections 50, annular projections 58 with a larger width are provided. Thereby, adjacent annular projections 58 contact and partially overlap each other, respectively. In case of such annular projections 58, rhomboid recesses 60 are formed between the projections for receiving excess bonding agent. The edge of the annular projections 58 facing towards the deepened portions 32 can be formed corresponding to the embodiment shown in FIG. 5. Further, the possibility exists to provide the annular projections 58 with recesses and the like, not illustrated, which also serve for taking up bonding agent.

The invention claimed is:

1. A sample carrier for receiving chemical and/or biological samples, comprising:

a receiving part provided with deepened portions for receiving samples; and a base part closing the deepened portions, the base part being connected to the receiving part at connection sites by means of a bonding agent, characterized in that the receiving part, or the base part, or the receiving part and the base part, are provided, at the connection sites, with at least one first recess and a plurality of second recesses disposed to receive excess bonding agent, wherein the second recesses are disposed between the deepened portions.

2. The sample carrier according to claim 1, characterized in that the receiving part includes inner edges facing towards the deepened portions, wherein the inner edges of the receiving part are provided with a rounded portion.

3. The sample carrier according to claim 1, characterized in that the first recess is provided in an edge region of the base part, or of the receiving part, or of the base part and of the receiving part.

4. The sample carrier according to claim 1, characterized in that the first recess is formed by a stepped portion provided in the receiving part outside the deepened portions.

5. The sample carrier according to claim 4, characterized in that the base part extends beyond the stepped portion to form the first recess as a gap-shaped recess.

6. The sample carrier according to claim 5, characterized in that the gap-shaped recess is formed continuously along the whole of an edge at a periphery of the base part.

7. The sample carrier according to any claim 1, characterized in that the first recess opens in the direction of an outer edge of the receiving part.

8. The sample carrier according to claim 1, characterized in that the base part is permeable to radiation to allow for the examination of the sample.

9. The sample carrier according to claim 1, characterized in that the base part comprises a plastic film or glass.

10. The sample carrier according to claim 1, characterized in that the thickness of the base part is smaller than 500 μm.

11. The sample carrier according to claim 1, characterized in that the receiving part is provided with centering elements determining the position of the base part.

12. The sample carrier according to claim 2, characterized in that the first recess is provided in an edge region of the base part, or of the receiving part, or of the base part and of the receiving part.

13. The sample carrier according to claim 2, characterized in that the first recess is formed by a stepped portion provided in the receiving part outside the deepened portions.

14. The sample carrier according to claim 3, characterized in that the first recess is formed by a stepped portion provided in the receiving part outside the deepened portions.

15. The sample carrier according to claim 1, characterized in that the thickness of the base part is smaller than 300 μm.

16. The sample carrier according to claim 3, characterized in that the first recess is formed by a stepped portion provided in the base part.

17. The sample carrier according to claim 1, wherein the first recess is formed by a stepped portion provided in the receiving part outside the deepened portions and the base part extends beyond the stepped portion to form the first recess as a gap-shaped recess, and the plurality of second recesses are connected together to form a single recess.

18. The sample carrier according to claim 1, wherein the first recess is formed by a stepped portion provided in the receiving part outside the deepened portions and the base part extends beyond the stepped portion to form the first recess as a gap-shaped recess, and the second recesses are rhomboid recesses.

19. The sample carrier according to claim 11, wherein the centering elements are cylindrical centering pins provided with a predetermined weakening line so that each centering pin is capable of breaking off from the sample carrier.

20. A sample carrier for receiving chemical and/or biological samples, comprising:

a receiving part provided with deepened portions for receiving samples; and a base part closing the deepened portions, the base part being connected to the receiving part at connection sites by means of a bonding agent, characterized in that the receiving part, or the base part, or the receiving part and the base part, are provided, at the connection sites, with a plurality of first recesses disposed to receive excess bonding agent, wherein the first recesses are disposed between the deepened portions; and wherein the receiving part, or the base part, or the receiving part and the base part, are additionally provided, at the connection sites, with at least one second recess disposed to receive excess bonding agent, wherein the second recess is provided in an edge region of the base part, or of the receiving part, or of the base part and of the receiving part, and the second recess is formed by a stepped portion in the base part, or the receiving part, or in the base part and the receiving part.

21. The sample carrier according to claim 20, wherein the second recess is formed by a stepped portion provided in the receiving part outside the deepened portions and the base part extends beyond the stepped portion to form the second recess as a gap-shaped recess, and the plurality of first recesses are connected together to form a single recess.

22. The sample carrier according to claim 20, wherein the second recess is formed by a stepped portion provided in the receiving part outside the deepened portions and the base part extends beyond the stepped portion to form the second recess as a gap-shaped recess, and the first recesses are rhomboid recesses.

* * * * *

UNITED STATES PATENT AND TRADEMARK OFFICE

CERTIFICATE OF CORRECTION

PATENT NO. : 7,393,506 B2
APPLICATION NO. : 10/466883
DATED : July 1, 2008
INVENTOR(S) : Olaf Sollböhmer It is certified that error appears in the above-identified patent and that said Letters Patent is hereby corrected as shown below:

On the Title Page, the following information should appear:

Foreign Application Priority Data

January 9, 2001 (DE) ..... 20100345.7

Signed and Sealed this

Twenty-fifth Day of November, 2008

JON W. DUDAS
*Director of the United States Patent and Trademark Office*